US008080945B2

(12) United States Patent
Chong et al.

(10) Patent No.: US 8,080,945 B2
(45) Date of Patent: Dec. 20, 2011

(54) MULTIPLE LAMP DRIVING DEVICE COMPRISING BALANCE TRANSFORMER

(75) Inventors: Won Sik Chong, Anyang-si (KR); Kyoung Ho Yoon, Hwaseong-si (KR); Yoon Seok Seo, Incheon-si (KR); Ki Hung Nam, Suwon-si (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 249 days.

(21) Appl. No.: 12/471,693

(22) Filed: May 26, 2009

(65) Prior Publication Data

US 2010/0237795 A1 Sep. 23, 2010

(30) Foreign Application Priority Data

Mar. 20, 2009 (KR) ..... 10-2009-0024034

(51) Int. Cl.
*H05B 41/14* (2006.01)

(52) U.S. Cl. ..... 315/256; 315/254; 315/255; 315/279; 315/291; 315/299

(58) Field of Classification Search ..... 315/274–291, 315/299, 307, 308, 312–326, 254–256
See application file for complete search history.

(56) References Cited

U.S. PATENT DOCUMENTS

| | | | | |
|---|---|---|---|---|
| 3,496,478 | A * | 2/1970 | Heinrich et al. | 327/3 |
| 7,088,213 | B2 * | 8/2006 | Chien et al. | 336/182 |
| 7,309,964 | B2 * | 12/2007 | Wey et al. | 315/312 |
| 7,663,322 | B2 * | 2/2010 | Kim et al. | 315/276 |
| 2007/0126369 | A1 | 6/2007 | Meng et al. | |
| 2007/0217183 | A1 | 9/2007 | Meng et al. | |
| 2009/0009097 | A1 * | 1/2009 | Li et al. | 315/209 R |

* cited by examiner

*Primary Examiner* — Douglas W Owens
*Assistant Examiner* — Thai Pham
(74) *Attorney, Agent, or Firm* — Lowe, Hauptman, Ham & Berner, LLP

(57) ABSTRACT

The present invention provides a multiple lamp driving capable of being applied to a multiple lamp system such as an LCD, wherein the multiple lamp driving device includes: a power supply unit for supplying a driving voltage to a lamp unit provided with first to 4nth lamps; and a balancing circuit unit including first to nth balance transformers for receiving the driving voltage from the power supply unit and balancing currents flowing through the first to 4nth lamps, wherein each of the first to nth balance transformers includes a primary side connected to the power supply unit in series and first and second secondary sides electrically connected to the primary side, each one end of the first and second secondary sides is connected to one end of one of the first to 4nth lamps, each of the other ends of the first and second secondary sides is connected to one end of another among the first to 4nth lamps, and the other ends of all of the first to 4nth lamps are connected to a ground.

3 Claims, 6 Drawing Sheets

[FIG. 1]
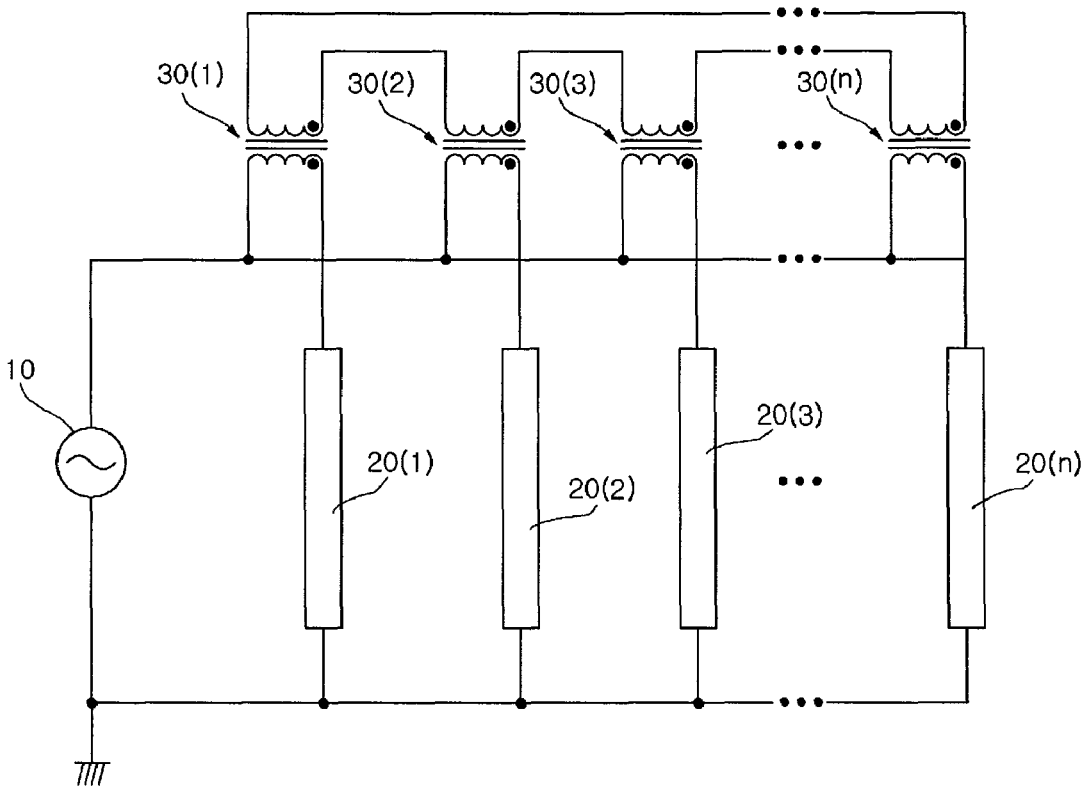
- PRIOR ART-

[FIG. 2]
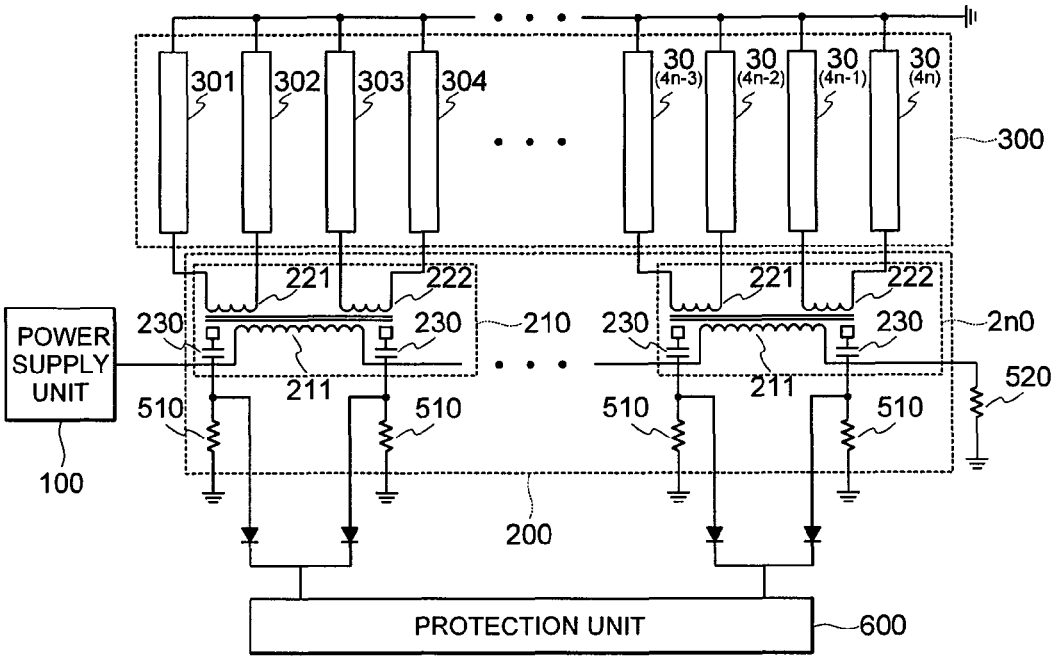

[FIG. 3]
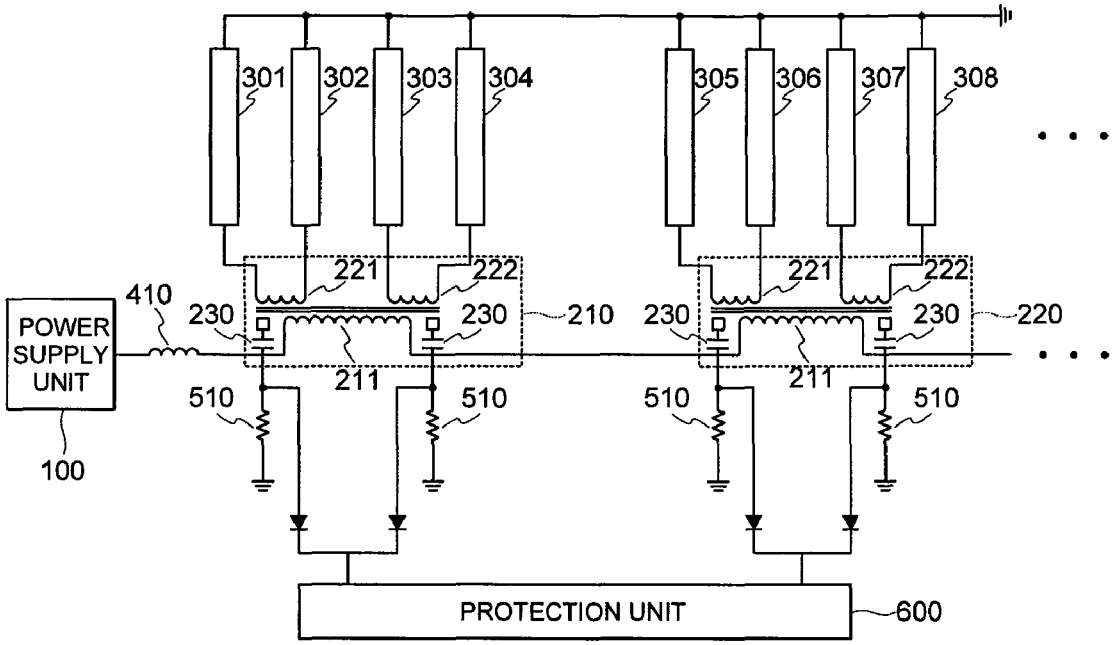

[FIG. 4]
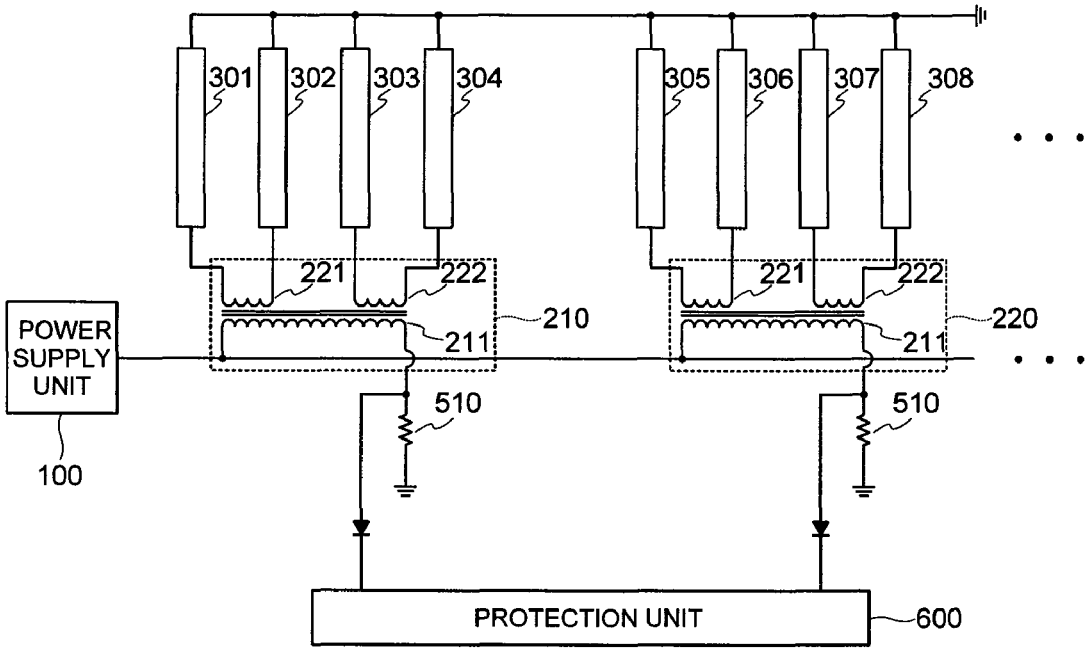

[FIG. 5]
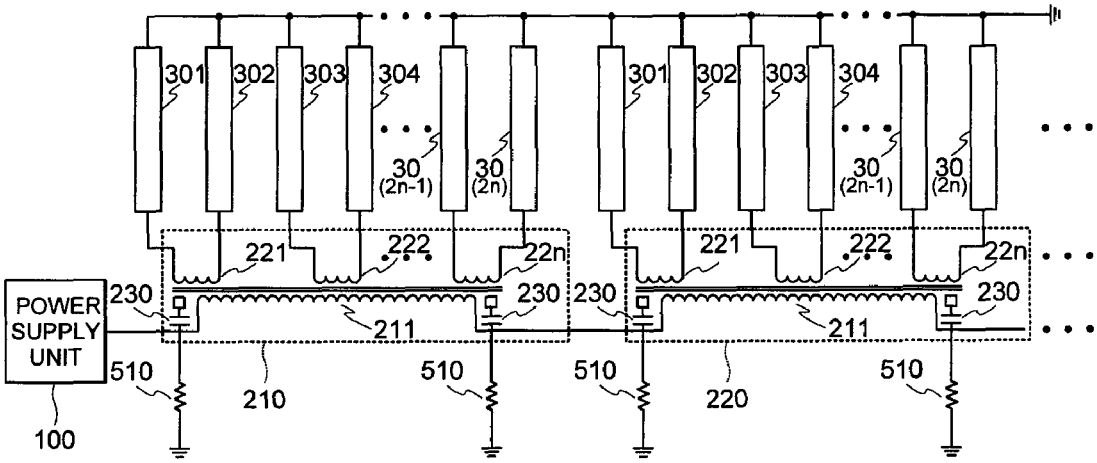

[FIG. 6]
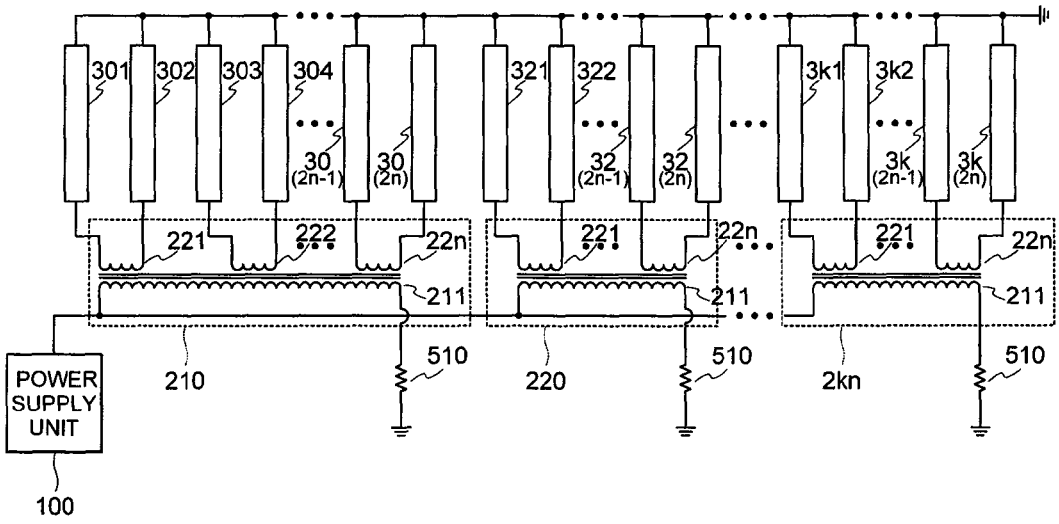

MULTIPLE LAMP DRIVING DEVICE COMPRISING BALANCE TRANSFORMER

CROSS-REFERENCE TO RELATED APPLICATIONS

This application claims the benefit of Korean Patent Application No. 10-2009-0024034 filed with the Korea Intellectual Property Office on Mar. 20, 2009, the disclosure of which is incorporated herein by reference.

BACKGROUND OF THE INVENTION

1. Field of the Invention

The present invention relates to a multiple lamp driving device capable of being applied to a multiple lamp system such as an LCD; and, more particularly, to a multiple lamp driving device comprising a balance transformer capable of balancing currents flowing through a plurality of lamps and reducing the number of balance transformers and the number of used elements to thereby remarkably reduce the entire area of a circuit by implementing a current balancing circuit including a plurality of balance transformers each of which includes a primary side, a first secondary side, and a second secondary side to thereby receive a high voltage from a voltage driving unit at the primary sides of the balance transformers, transmit the high voltage to the first secondary sides and the second secondary sides, and transmit driving power to the lamps connected to the secondary sides.

2. Description of the Related Art

Recently, various studies have been progressed in the field of inverter that is one of many elements constituting an LCD (Liquid Crystal Display) to reduce a manufacture cost. Approximately 16 to 24 CCFLs(Cold Cathode Fluorescent Lamps) are used to manufacture a backlight of an LCD TV and the same number of inverters are also required to drive it.

Meanwhile, if one inverter drives a plurality of lamps in parallel, it is expected to radically cut the cost. However, it is known that because as for a general CCFL, lamp resistance values differently change in ignition and in burning, it is difficult to drive the CCFLs in parallel.

It is known that if a current balancing transformer is used when driving them in parallel in order to overcome the above problem, it is possible to turn on multiple lamps and balance currents.

A method where one inverter can many lamps at the same time by using the current balancing transformer is referred to as a current balance method. As for the current balance method, there is a Jin balancing method, a Zaulas method, or an O2 micro method and a multiple lamp driving device using the Jin balancing method is described with reference to FIG. 1.

FIG. 1 is a construction view showing a conventional multiple lamp driving device and referring to FIG. 1, the conventional multiple lamp driving device includes an AC power source 10 for supplying driving power, a plurality of lamps 20(1)~20(n) turned on by the driving power from the AC power source 10, and current balancing circuits 30(1)~30(n) for uniformly balancing currents flowing through the lamps 20(1)~20(n).

Herein, the current balancing circuits 30(1)~30(n) include first to nth balance transformers individually corresponding to the lamps in order to uniformize the currents flowing through the lamps. A current balance principle of the current balancing circuit is known and therefore explanation thereof is omitted.

However, since the conventional multiple lamp driving device should use the balance transformers as many as the lamps, the entire area of the circuit are increased with increment of the number of the used elements, thereby complicating the circuit and increasing the manufacture cost.

SUMMARY OF THE INVENTION

The present invention has been proposed in order to overcome the above-described problems and it is, therefore, an object of the present invention to provide a multiple lamp driving device applied to a multiple lamp system such as an LCD capable of balancing currents flowing through a plurality of lamps and reducing the number of balance transformers and the number of used elements to thereby remarkably reduce the entire area of circuit by implementing a current balancing circuit including a plurality of balance transformers each of which includes a primary side, a first secondary side, and a second secondary side to thereby receive a high voltage from a voltage driving unit at the primary sides of the balance transformers, transmit the high voltage to the first secondary side and the second secondary side, and transmit driving power to the lamps connected to the secondary sides.

In accordance with one aspect of the present invention to achieve the object, there is provided a multiple lamp driving device provided with a balance transformer including: a power supply unit for supplying a driving voltage to a lamp unit provided with first to 4nth lamps; and a balancing circuit unit including first to nth balance transformers for receiving the driving voltage from the power supply unit and balancing currents flowing through the first to 4nth lamps, wherein each of the first to nth balance transformers includes a primary side connected to the power supply unit in series and first and second secondary sides electrically connected to the primary side, each one end of the first and second secondary sides is connected to one end of one of the first to 4nth lamps, each of the other ends of the first and second secondary sides is connected to one end of another among the first to 4nth lamps, and the other ends of all of the first to 4nth lamps are connected to a ground.

Further, each of the first to nth balance transformers includes organic capacitors at both ends in order to protect the first to 4nth lamps in erroneous operation.

Further, each of the first to nth balance transformers includes first sensing resistors between the organic capacitors and the ground.

Further, the multiple lamp driving device includes a second sensing resistor between a primary side of the nth balance transformer and the ground.

Further, the multiple lamp driving device includes a sensing coil between the power supply unit and a primary side of the first balance transformer.

In accordance with another aspect of the present invention to achieve the object, there is provided a multiple lamp driving device provided with a balance transformer including: a power supply unit for supplying a driving voltage to a lamp unit provided with first to 4nth lamps; and a balancing circuit unit including first to nth balance transformers for receiving the driving voltage from the power supply unit and balancing currents flowing through the first to 4nth lamps, wherein each of the first to nth balance transformers includes a primary side connected to the power supply unit in parallel and first and second secondary sides electrically connected to the primary side, each one end of the first and second secondary sides is connected to one end of one of the first to 4nth lamps, each of the other ends of the first and second secondary sides is connected to one end of another among the first to 4nth lamps, and the other ends of all of the first to 4nth lamps are connected to a ground.

Further, the multiple lamp driving device includes first sensing resistors between the primary sides of the balance transformers and the ground.

In accordance with still another aspect of the present invention to achieve the object, there is provided a multiple lamp driving device provided with a balance transformer including: a power supply unit for supplying a driving voltage to a plurality of lamps; and a balancing circuit unit including at least one balance transformers for receiving the driving voltage from the power supply unit and balancing currents flowing through the lamps, wherein each of the balance transformers includes a primary side connected to the power supply unit and a first secondary side to an nth secondary side electrically connected to the primary side, each one end of the first secondary side to the nth secondary side is connected to one end of one of the lamps, each of the other ends of the first secondary side to the nth secondary side is connected to one end of another among the lamps, and the other ends of the lamps are connected to a ground.

Further, in the case where the number of the lamps is 2kn, the number of the balance transformers for balancing the currents flowing through 2n lamps is k.

Further, the primary side of each of the balance transformers is connected to the power supply unit in series.

Further, the primary side of each of the balance transformers is connected to the power supply unit in parallel.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a construction view showing a conventional multiple lamp driving device;

FIG. 2 is a construction view illustrating a multiple lamp driving device in accordance with a first embodiment of the present invention;

FIG. 3 is a construction view illustrating a multiple lamp driving device in accordance with a second embodiment of the present invention;

FIG. 4 is a construction view illustrating a multiple lamp driving device in accordance with a third embodiment of the present invention;

FIG. 5 is a construction view illustrating a multiple lamp driving device in accordance with a fourth embodiment of the present invention; and FIG. 6 is a construction view illustrating a multiple lamp driving device in accordance with a fifth embodiment of the present invention.

DETAILED DESCRIPTION OF THE PREFERABLE EMBODIMENTS

Matters regarding to an operation effect including a technical configuration of a multiple lamp driving device in accordance with the present invention to achieve the object will be appreciated clearly through the following detailed description with reference to the accompanying drawings illustrating preferable embodiments of the present invention.

Hereinafter, the present invention will be described in detail with reference to the drawings.

FIG. 2 is a construction view illustrating a multiple lamp driving device in accordance with a first embodiment of the present invention.

The multiple lamp driving device including a balance transformer in accordance with the present invention includes a power supply unit 100; a balance circuit unit 200; a protection unit 600; and a lamp unit 300.

The power supply unit 100 supplies an input voltage with high voltage to the lamp unit 300 and the lamp unit 300 includes first to 4nth lamps 301 to 30(4n).

The balance circuit unit 200 is provided to balance tube currents of the lamps in the case where a plurality of lamps are driven and includes first to nth balance transformers 210 to 2n0. The balance transformers may use transformers which have been used to boost a voltage in a conventional inverter board. For example, the transformer was used to boost a low input voltage of 24V to a high voltage of approximately 1200V in the inverter board, while the balance transformer of the present invention does not perform a boosting function but performs a current distribution function. The multiple lamp driving device can balance currents by receiving the high voltage from the voltage supply unit at a primary side 211 of the balance transformer, transmitting high voltage output(an inverted phase structure) with the same size to a secondary side, and passing the equal current to each of the lamps.

Further, each of the first to nth balance transformers 210 to 2n0 includes a primary side 211 connected to the power supply unit 100 in series and first and second secondary sides 221 and 222 electrically connected to the primary side 211. And, each one end of the first secondary side 221 and the second secondary side 222 is connected to one lamp and each of the other ends of the first secondary side 221 and the second secondary side 222 is connected to another lamp. In addition, the other ends of the first to 4nth lamps 301 to 30(4n) are connected to a ground.

For instance, as shown in FIG. 2, the one end of the first secondary side 221 of the first balance transformer 211 is connected to a first lamp 301, the other end thereof is connected to a second lamp 302, the one end of the second secondary side 222 of the first balance transformer 210 is connected to a third lamp 303, and the other end thereof is connected to a fourth lamp 304. Therefore, the first balance transformer 210 can balance four lamps, i.e., in the case where the balance circuit unit 200 has n balance transformers, it can balance 4n lamps. According to the related art, one coil or transformer is included in order to balance one lamp and therefore there is a disadvantage of increasing the number of used elements and the entire area of circuit, while in accordance with the present invention, the multiple lamp driving device can drive 4 lamps with one transformer, thereby reducing the number of used elements and the entire area of circuit.

Meanwhile, in order to protect the first to 4n lamps 301 to 30(4n) in erroneous operation, each of the first to nth balance transformers 210 to 2n0 includes organic capacitors 230 at both ends. The organic capacitor 230 plays a role of a capacitor when mounting a hollow pin inside the balance transformer to thereby operate as a protection circuit in the erroneous operation such as off of the lamp.

In addition, each of the first to nth balance transformers 210 to 2n0 further includes first sensing resistors 510 between the organic capacitors 230 and grounds. The first sensing resistors 510 can adjust the current amount by sensing the currents.

Further, the present invention includes a second sensing resistor 520 between the primary side 211 of the nth balance transformer 2n0 and a ground. Like the first sensing resistors 510, the second sensing resistor 520 can adjust the current amount by sensing the currents.

Meanwhile, FIG. 3 is a construction view illustrating a multiple lamp driving device in accordance with a second embodiment of the present invention.

Although the second embodiment is similar to the first embodiment shown in FIG. 2 in that a power supply unit 100 and primary sides 211 of the first to nth balance transformers 210 to 2n0 are connected in series, the second embodiment includes a sensing coil 410 between the power supply unit 100 and the primary side 211 of the first balance transformer 210 instead of the second sensing resistor 520.

Both of the multiple lamp driving devices in accordance with the first and second embodiments include protection units 600 for shutting down lamps in erroneous operation. The protection unit 600 may be implemented with the same or similar construction as or to a protection unit which is used in a conventional balance circuit such as a Jin balance circuit.

Meanwhile, FIG. 4 is a construction view illustrating a multiple lamp driving device in accordance with a third embodiment of the present invention.

As shown in FIG. 4, the multiple lamp driving device includes a power supply unit 100; a balance circuit unit 200; a protection unit 600; and a lamp unit 300. Like the first and second embodiments, the multiple lamp driving device includes a balance transformer unlike the related art such as a Jin balance.

Only, the balance circuit unit 200 includes first to nth balance transformers 210 to 2n0 and each of the first to nth balance transformers includes a primary side 211 connected to the power supply unit 100 in parallel and first and second secondary sides 221 and 222 which are electrically connected to the primary side 211. That is, unlike the first and second embodiments, the balance transformers are connected to the power supply unit 100 in parallel.

Meanwhile, each one end of the first secondary side 221 and the second secondary side 222 is connected to one lamp and each of the other ends of the first secondary side 221 and the second secondary side 222 is connected to another lamp. Further, the third embodiment is similar to the first and second embodiments in that the other ends of the first to 4nth lamps 301 to 30(4n) are connected to a ground. Therefore, even in the multiple lamp driving device shown in FIG. 4 in accordance with the third embodiment, the first balance transformer 210 can balance 4 lamps, i.e., in the case where the balance circuit unit 200 has n balance transformers, 4n lamps can be balanced and therefore it is possible to 4 lamps with one transformer, thereby reducing the number of used elements and the entire area of the circuit.

Further, in accordance with the third embodiment, the primary side 211 of each of the first to nth balance transformers 210 to 2n0 is connected to a first sensing resistor 510 of which one end is connected to the power supply unit 100 and the other end is connected to a ground. Although the first and second embodiments use the organic capacitors 230 to thereby perform a protection operation in erroneous operation such as off of the lamp, the present embodiment in which the primary sides of the transformers are connected in parallel can achieve a protection function with only the first sensing resistors 510 and therefore has a great advantage in terms of the number of elements and the entire area of the circuit.

Meanwhile, FIG. 5 is a construction view illustrating a multiple lamp driving device in accordance with a fourth embodiment of the present invention.

The multiple lamp driving device in accordance with the present invention includes a power supply unit 100 for supplying a driving voltage to a plurality of lamps; and a balancing circuit unit including at least one balance transformer which receives the driving voltage from the power supply unit 100 and balances currents flowing through the lamps.

Only, the fourth embodiment is different from the first to third embodiments in that the balance transformer includes a primary side 211; and first to nth secondary sides 221 to 22n. The primary side 211 of the balance transformer is connected to the power supply unit 100 in series. Each one end of the first secondary side to the nth secondary side 221 to 22n electrically connected to the primary side is connected to one end of one of the lamps, each of the other ends of the first secondary side to the nth secondary side 221 to 22n is connected to one end of another among the lamps, and all of the other ends of the lamps are connected to a ground.

As shown in FIG. 5, the balance transformer includes n secondary sides each of which is connected to two lamps. One end of a first secondary side 221 is connected to a first lamp 301, the other end thereof is connected to a second lamp 302, one end of a second secondary side 222 is connected to a third lamp 303, and the other end thereof is connected to a fourth lamp 304. In other words, each of the balance transformers including the n secondary sides can balance currents flowing through 2n lamps and in the case where the number of the balance transformers is k, 2kn lamps can be driven. Therefore, although like the first to third embodiments, one balance transformer may be generally implemented in such a manner as to balance the currents flowing through 4 lamps by including 2 secondary sides, the multiple lamp driving device having the optimal number of elements and area of the circuit can be implemented by adjusting the number of the secondary sides and the number of the balance transformers by those skilled in the art, if necessary.

For example, even though as increasing the number of the secondary sides, the size of the balance transformer is increased, there is an advantage in that one balance transformer can balance a plurality of lamps at the same time. Similarly, in the case of balancing 4n lamps with the balance transformer having two secondary sides capable of balancing 4 lamps, even though the size of the balance transformer can be reduced, n balance transformers should be used.

The following table shows the comparison between the size of a Jin balancing coil in a balance board using a conventional Jin balance principle and the size of the balance transformer having two secondary sides in accordance with the present invention.

TABLE 1

Comparison between the size of the Jin balance coil according to the related art and the size of the balance transformer in accordance with the present invention

| Item | Number | Size of core (mm) | Size of bobbin (mm) |
|---|---|---|---|
| Related art | Number of lamps | 13 * 16 | 23.8 * 13.2 |
| Present invention | Number of lamps/4 | 15 * 56 | 48.6 * 28.7 |

Although as shown in Table 1, the sizes of core and bobbin of the present invention are larger than those of the Jin balance coil of the related art, the number is reduced to ¼ and so it is possible to reduce the entire area of circuit. In addition, although a conventional Jin balance circuit performs a protection function by using a third winding not the organic capacitor like the present invention, it is patent technology and therefore in the case of using the Jin balance circuit, there is a disadvantage in that a patent loyalty should be paid in addition to a manufacture cost of the circuit. However, the multiple lamp driving device in accordance with the present invention can overcome the disadvantage of paying the patent loyalty and reduce the entire area of circuit by using the organic capacitor or the like not the third winding technology, thereby reducing the number of elements and the entire area of circuit to reduce the manufacture cost or the like.

Meanwhile, in order to protect the first to 4nth lamps 301 to 30(4n) in erroneous operation, each of the first to nth balance transformers 210 to 2n0 includes organic capacitors 230 at both ends and each of the first to nth balance transformers 210 to 2n0 includes first sensing resistors 510 between the organic capacitors 230 and grounds. The first sensing resistors can adjust the current amount by sensing currents.

Further, since like the first and second embodiments, the primary sides of the balance transformers are connected in series, the fourth embodiment also can adjust the current amount by including a second sensing resistor 520 between a primary side 211 of an nth balance transformer 2n0 and a ground or a sensing coil 410 between the power supply unit 100 and a primary side 211 of a first balance transformer 210 instead of the second sensing resistor 520.

Meanwhile, FIG. 6 is a construction view illustrating a multiple lamp driving device in accordance with a fifth embodiment of the present invention.

The multiple lamp driving device in accordance with the present invention includes a power supply unit 100 for supplying a driving voltage to a plurality of lamps; and a balancing circuit unit including at least one balance transformer for receiving the driving voltage from the power supply unit 100 and balancing currents flowing through the lamps, wherein the balance transformer includes a primary side 211; and a first secondary side to an nth secondary side 221 to 22n. General idea of the fifth embodiment is similar to that of the fourth embodiment. Only, the fifth embodiment is different from the fourth embodiment in that a primary side 211 of the at least one balance transformer is connected to the power supply unit 100 in parallel.

Each one end of the first secondary side to the nth secondary side 221 to 22n electrically connected to the primary side 211 of the balance transformer is connected to one end of one of the lamps, each of the other ends of the first secondary side to the nth secondary side 221 to 22n is connected to another of the lamps, and the other ends of the lamps are connected to a ground.

Referring to FIG. 6, the first balance transformer 210 includes n secondary sides each of which is connected to two lamps. One end of the first secondary side is connected to a first lamp 301, the other end thereof is connected to a second lamp 302, one end of a second secondary side is connected to a third lamp 303, and the other end thereof is connected to a fourth lamp 304. Namely, the fifth embodiment is similar to the fourth embodiment in that each of the balance transformers including n secondary sides can balance currents flowing through 2n lamps and in the case where the number of the balance transformers is k, it is possible to drive 2kn lamps.

Further, since in the fifth embodiment like the third embodiment, the primary sides of the balance transformers are connected in parallel, the primary side 211 of each of the first to nth balance transformers 210 to 2n0 is connected to first sensing resistors 510 of which one ends are connected to the power supply unit 100 and the other ends thereof are connected to grounds. With the primary sensing resistors 510, the present embodiment performs a protection function in erroneous operation such as off of the lamp and a function of adjusting the current amount.

As described above, in accordance with the present invention, the multiple lamp driving device capable of being applied to the multiple lamp system such as the LCD can balance the currents flowing through the lamps and reduce the number of balance transformers and the number of used elements to thereby remarkably reduce the entire area of circuit by implementing the current balancing circuit including the balance transformers each of which includes the primary side, the first secondary side, and the second secondary side to thereby receive the high voltage from the voltage driving unit at the primary sides of the balance transformers, transmit the high voltage to the first secondary sides and the second secondary sides, and transmit the driving power to the lamps connected to the secondary sides.

Further, in accordance with the present invention, the multiple lamp driving device can drive 2kn lamps by including k balance transformers each of which includes the primary side and n secondary sides individually connected to two lamps since each of the balance transformers including the n secondary sides can balance the currents flowing through 2n lamps and the number of the balance transformers is k.

As described above, although the preferable embodiments of the present invention have been shown and described, it will be appreciated by those skilled in the art that substitutions, modifications and variations may be made in these embodiments without departing from the principles and spirit of the general inventive concept, the scope of which is defined in the appended claims and their equivalents.

What is claimed is:

1. A multiple lamp driving device, comprising:

a power supply unit for supplying a driving voltage to a lamp unit provided with first to $4n^{th}$ lamps; and a balancing circuit unit including first to $n^{th}$ balance transformers for receiving the driving voltage from the power supply unit and for balancing currents flowing through the first to $4n^{th}$ lamp, wherein each of the first to nth balance transformers includes:

a primary side connected to the power supply unit in series;

first and second secondary sides coupled with the primary side;

capacitors positioned at both ends of the corresponding balance transformer, without being electrically connected to the primary side or the first and second secondary sides, in order to protect the first to $4n^{th}$ lamps in an erroneous operation; and first sensing resistors positioned between the capacitors and the ground, the first sensing resistors being configured to allow currents from the capacitors to flow into the ground through the first sensing resistors, wherein one end of each of the first and second secondary sides is connected to one end of one of the first to $4n^{th}$ lamps, the other end of each of the first and second secondary sides is connected to one end of another among the first to $4n^{th}$ lamps, and the other ends of all of the first to $4n^{th}$ lamps are connected to a ground.

2. The multiple lamp driving device of claim 1, further comprising:

a second sensing resistor between the primary side of the $n^{th}$ balance transformer and the ground.

3. The multiple lamp driving device of claim 1, further comprising:

a sensing coil between the power supply unit and the primary side of the first balance transformer.

* * * * *